United States Patent [19]

Leonard

[11] 4,136,902

[45] Jan. 30, 1979

[54] SHOWER SOAP RETRIEVER

[76] Inventor: Donald L. Leonard, P.O. Box 305, Cornell, Ill. 61319

[21] Appl. No.: 845,847

[22] Filed: Oct. 27, 1977

[51] Int. Cl.[2] ..... A47F 13/06; B25J 1/04

[52] U.S. Cl. ..... 294/55; 294/19 R

[58] Field of Search ..... 294/1 R, 2, 19 R, 19 A, 294/49, 55; D6/89, 90; D7/47; 30/325; 209/417, 418; 210/470; 401/88

[56] References Cited

U.S. PATENT DOCUMENTS

| | | | |
|---|---|---|---|
| D. 121,398 | 7/1940 | Sanford | D6/89 |
| D. 130,579 | 12/1941 | Dreyfuss | D6/89 |
| D. 223,841 | 6/1972 | Bohan | D6/89 |
| 387,236 | 8/1888 | Knowlton | 210/470 |
| 1,667,045 | 4/1928 | Ogden | 401/88 |
| 1,675,022 | 6/1928 | Creegan | 401/88 |
| 3,106,419 | 10/1963 | Estwing | 294/55 X |
| 3,169,790 | 2/1965 | Kaanehe | 294/19 A |

FOREIGN PATENT DOCUMENTS

| | | | |
|---|---|---|---|
| 12801 of | 1909 | United Kingdom | 30/325 |

*Primary Examiner*—Johnny D. Cherry
*Attorney, Agent, or Firm*—Blair, Brown & Kreten

[57] ABSTRACT

Disclosed herein is a soap retriever preferably for use in a bathtub or shower environment comprising an elongate handle having a slot at one terminal portion of the handle for attachment on a hook on the wall, and a inverted U-shaped receptor area having a bottom platform and a closed back portion for picking up and carrying a bar of soap that has been dropped. The bottom platform is provided with ribs upstanding from the base and orifices between the ribs on the base member to provide drainage so that the soap can conceiveably be retained in this retrival device when not being used.

3 Claims, 4 Drawing Figures

SHOWER SOAP RETRIEVER

BACKGROUND OF THE INVENTION

1. Field of the Invention

Providing a means for retrieving dropped soap in a shower or bath environment is an important consideration for people who are infirmed, are unable to bend down and pick up the soap, and for people who do not want to get their hair wet for example and find that the soap is directly in the water spray. To this end, the prior art is remarkably silent on providing relief for these people.

Prior art of which applicant is aware includes U.S. Pat. Nos. 1,675,022 to Creegan, U.S. 1,927,350 to Schopp, U.S. 2,707,651 to Ott, U.S. 2,895,363 to Cox, 3,010,500 to Jordan and U.S. 3,106,419 to Estwing. None of these references provides a means by which dropped soap can not only be retrieved but also ensure that the soap residing within this receptor according to the present invention will not get soft or stuck in the receptor by virtue of the drainage holes.

SUMMARY OF THE INVENTION

Accordingly, it is an object of this invention to devise a soap retrieval device which can reliably pick up an errant bar of soap.

Another object is to provide a soap retriever that will assist infirm people.

Another object of the invention contemplates providing a soap retriever provided with means for draining accumulated water in the receptor and providing a storage or nesting area for the soap when it is not in use.

A further object provides means for hanging up the receptor when it is not in use.

Other objects and advantages will become apparent in the following specification when considered in light of the attached drawings.

Figure 1:
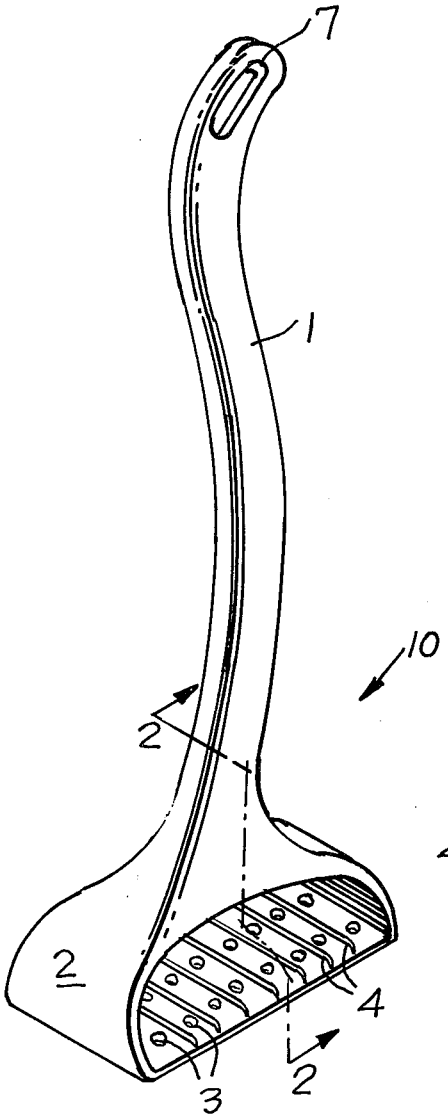
FIG. 1 is a three quarter view of the soap retriever according to the present invention.
Figure 2:
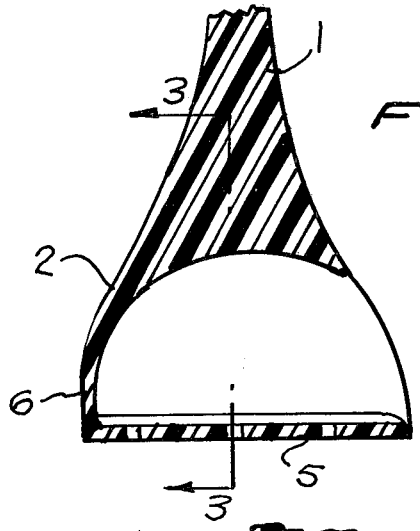
FIG. 2 is a sectional view taken along lines 2—2 of FIG. 1.
Figure 3:
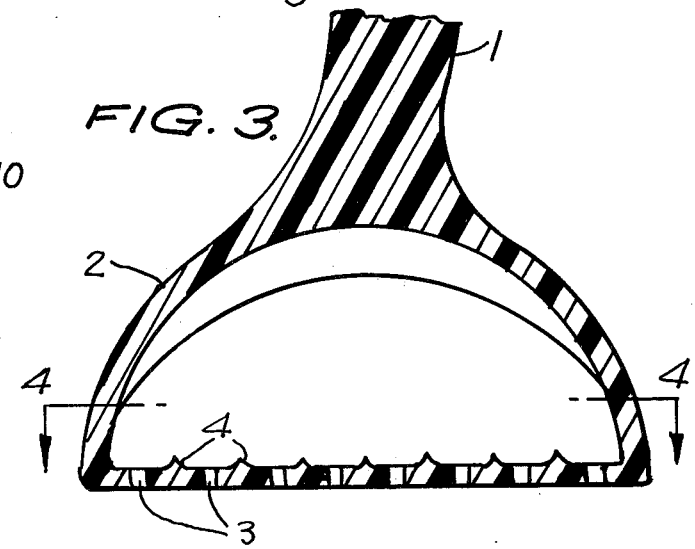
FIG. 3 is a sectional view taken along lines 3—3 of FIG. 2.
Figure 4:
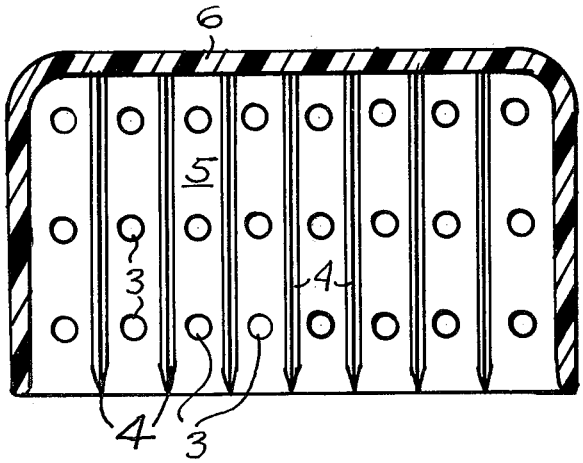
FIG. 4 is a sectional view taken along lines 4—4 of FIG. 3. DESCRIPTION OF THE PREFERRED EMBODIMENT Referring to the drawings now wherein like reference numerals refer to like parts throughout reference numeral 10 generally denotes the soap retriever according to the present invention.

Soap retriever 10 generally can be regarded as a receptacle 2 having a U-shaped configuration, an open face and a closed back face 6. The bottom face 5 of the soap retriever is provided with a plurality of orifices 3 linearly disposed and separated in a longitudinal matrix or array by means of upstanding ribs 4. The soap retrieval housing 2 extends to and terminates in a handle 1 of generally curved or S configuration and the extremity remote from the receptor 2 has an elongate slot 7 which lends itself to placement upon a hook or nail or similar projection in the bathtub or shower environment. Preferably, the apparatus according to the present invention can be fashioned from any suitable plastic and in use one merely takes the handle off the peg that the receptacle or shower retriever is mounted on and picks up the bar of soap by urging it into the open face of the U-shaped receptor. When not in use, the shower soap retriever can serve as a nesting area of the soap and it will be noted that in view of the ridges and orifices provided on the bottom face of the retriever no water build up is allowed thereby assuring that the hardness of the soap will not be compromised by water.

Having thus described the preferred embodiment of the invention it should be understood that numerous structural modifications and adaptations may be resorted to without departing from the spirit of the invention.

What is claimed is:

1. A shower soap retriever comprising a handle having a slot at one extremity and a U-shaped receptor at its other extremity and a length to reach the ground when the user is generally erect, an open face on said U-shaped receptor, a closed face opposite said open face, a substantially planar base portion closing the U-shaped receptor thereby providing a nesting tray and orifices disposed upon said base portion to allow water drainage and linear ribs are disposed on the base portion oriented from the open to closed faces of the U-shaped receptor which taper downwardly to said open face to provide removal of the soap from the base portion thereby assuring that the soap will not become soft by tangential relation of the soap to the base, and also whereby the tapering portion will assist in sliding said soap into said receptor.

2. The apparatus of claim 1 in which said receptor is made of plastic.

3. The device of claim 2 in which said handle has a generally S-shaped configuration.

* * * * *